US008943870B2

(12) United States Patent
Rouweler et al.

(10) Patent No.: US 8,943,870 B2
(45) Date of Patent: Feb. 3, 2015

(54) DEVICE FOR CLAMPING A TOOL

(75) Inventors: Franciscus Wilhelmus Rouweler, AS Arnhem (NL); Jan Peters, NH Apeldoorn (NL); Jan Holterman, XP Delden (NL)

(73) Assignee: Wila B.V., Lochem (NL)

( * ) Notice: Subject to any disclaimer, the term of this patent is extended or adjusted under 35 U.S.C. 154(b) by 433 days.

(21) Appl. No.: 13/124,342

(22) PCT Filed: Nov. 11, 2009

(86) PCT No.: PCT/NL2009/000216

§ 371 (c)(1),
(2), (4) Date: Jun. 29, 2011

(87) PCT Pub. No.: WO2010/056110

PCT Pub. Date: May 20, 2010

(65) Prior Publication Data

US 2011/0247389 A1 Oct. 13, 2011

(30) Foreign Application Priority Data

Nov. 11, 2008 (NL) ..... 2002198

(51) Int. Cl.
*B21D 5/02* (2006.01)
*B21D 37/04* (2006.01)
*B21D 37/14* (2006.01)

(52) U.S. Cl.
CPC ..... *B21D 5/0209* (2013.01)
USPC ..... 72/481.1; 72/481.2; 72/481.6; 72/482.1; 72/482.3; 72/482.6

(58) Field of Classification Search
CPC .. B21D 5/0209; B21D 5/0236; B21D 5/0245; B21J 13/03
USPC ..... 72/462, 481.1, 481.2, 481.6, 482.1, 72/482.2, 482.3, 482.6, 482.9, 482.94
See application file for complete search history.

(56) References Cited

U.S. PATENT DOCUMENTS 4,993,255 A * 2/1991 Treillet ..... 72/462
5,245,854 A 9/1993 Bruggink et al.
5,794,486 A 8/1998 Sugimoto et al.

(Continued)

FOREIGN PATENT DOCUMENTS

CN 1125647 A 7/1996
CN 1155455 A 7/1997

(Continued)

*Primary Examiner* — David B Jones
(74) *Attorney, Agent, or Firm* — The Webb Law Firm

(57) ABSTRACT

Disclosed is a clamping device for clamping a tool, which includes a part receiving the tool, an actuated member and an engaging member to be brought into contact with the tool. The clamping device is further provided with a transmission placed between the actuated member and the engaging member. The actuated member can be pneumatically or electrically driven, and includes for instance a pneumatic jack, an electric motor or a piezoelectric element or an electromagnet. The actuated member can also be hydraulically driven. The transmission can include a wedge-shaped member or a lever. The clamping device can be self-braking.

24 Claims, 7 Drawing Sheets

(56) References Cited

U.S. PATENT DOCUMENTS

| | | | | | |
|---|---|---|---|---|---|
| 6,000,273 | A | * | 12/1999 | Stover | 72/482.3 |
| 6,138,492 | A | * | 10/2000 | Vining et al. | 72/481.1 |
| 6,151,951 | A | * | 11/2000 | Kawano | 72/481.2 |
| 6,263,721 | B1 | * | 7/2001 | Kawano | 72/481.6 |
| 6,467,327 | B1 | * | 10/2002 | Runk et al. | 72/481.1 |
| 6,644,090 | B2 | * | 11/2003 | Gasparini | 72/482.2 |
| 6,928,852 | B2 | * | 8/2005 | Enderink | 72/481.1 |
| 7,152,453 | B2 | * | 12/2006 | Johnson et al. | 72/481.1 |
| 7,159,439 | B2 | * | 1/2007 | Gascoin et al. | 72/482.2 |
| 7,308,817 | B2 | * | 12/2007 | Shimota et al. | 72/482.1 |
| 7,721,586 | B2 | * | 5/2010 | Pabich et al. | 72/481.1 |
| 8,099,992 | B2 | * | 1/2012 | Rouweler et al. | 72/481.2 |
| 8,496,255 | B2 | | 7/2013 | Rouweler | |
| 2008/0252024 | A1 | | 10/2008 | Rouweler | |

FOREIGN PATENT DOCUMENTS

| | | | |
|---|---|---|---|
| CN | 101085505 | A | 12/2007 |
| DE | 3604071 | A1 | 8/1987 |
| EP | 0494714 | A1 | 7/1992 |
| EP | 1413368 | A1 | 4/2004 |
| EP | 1486828 | A2 | 12/2004 |
| EP | 1980337 | A1 | 10/2008 |
| FR | 2122977 | A5 | 9/1972 |
| JP | 5041183 | U | 4/1975 |
| JP | 62187039 | A | 8/1987 |
| JP | 4294822 | A | 10/1992 |
| JP | 4319097 | A | 11/1992 |
| JP | 2005144762 | A | 6/2005 |
| JP | 2007185689 | A | 7/2007 |
| JP | 2007235179 | A | 9/2007 |
| JP | 2008260066 | A | 10/2008 |

* cited by examiner

DEVICE FOR CLAMPING A TOOL

BACKGROUND OF THE INVENTION

1) Field of the Invention

The invention relates to a clamping system for tools, in particular a clamping system for clamping tools in a press brake or fold-bending machine.

2) Description of the Prior Art

A press brake has an elongate lower beam and upper beam which are parallel to each other and can be moved toward and away from each other. Tools with which plate steel can for instance be bent are clamped in the lower beam and upper beam. By placing a steel plate between the tools of the upper beam and lower beam and moving the upper beam and lower beam toward each other the steel plate is pressed down between the tools and deformed so that a bending takes place which depends on the form of the tool.

In the prior art the clamping of such tools takes place, among other ways, by a mechanical clamping by means of clamp plates. Such a clamp plate is a plate which can be secured on the upper beam or lower beam by a bolt. The tool is placed between this clamp plate and the beam, after which the bolt is tightened and the tool is fixedly clamped. The clamping by means of clamp plates is a simple construction, but the clamping takes time since each bolt must be tightened manually.

Another frequently used clamping method is clamping of the tool with a hydraulically operated positioning pin. The positioning pin is arranged in the clamping beam and protrudes into the groove of the clamping beam into which the tool is placed. The clamping beam is normally mounted on an upper beam or lower beam of the press brake, or integrated therein. The upper beam and/or the lower beam is displaceable here toward the other beam. A hydraulic pressure unit is placed behind the positioning pin. This can be a hydraulic cylinder, although a better solution is a bellows. Once the tool has been arranged in the beam a hydraulic pressure is built up, whereby the positioning pin is pressed into the groove and thereby clamps the tool fixedly in the beam. A considerable hydraulic pressure is necessary in such a clamping construction, since the tool is clamped directly by the hydraulic pressure via the positioning pin. It is therefore usual to provide an external hydraulic unit for such clamping systems so as to enable a sufficient supply of hydraulic pressure. In the case of a hydraulically driven press it would be possible per se to envisage use being made of the hydraulic system of the press itself for the purpose of operating the clamping system. This is usually impractical however, since this hydraulic system operates at very high pressures and pressure peaks will moreover often occur during the pressing.

The positioning pin can further be provided on the end protruding into the groove with a chamfering which co-acts with an optionally truncated V-shaped positioning groove in the side surface of the tool. When the positioning pin is pressed into the groove of the beam the chamfering of the pin will be pressed into the positioning groove. Owing to the inclining contact surface the tool will on the one hand be clamped fixedly by the positioning pin, but on the other also be pressed upward so that the tool is properly clamped and positioned in the groove of the beam.

In order to prevent the tools from falling out of the clamping beam during insertion or release, the tools can be provided with a safety catch. This safety catch engages in a recess in the clamping beam. This recess is usually a horizontal groove in the clamping beam. The safety catch can be operated so that the safety catch can be retracted in order to place the tool vertically into the groove of the clamping beam, after which the safety catch is extended again and the ridge protrudes into a horizontal groove of the clamping beam.

When the safety catch cannot be operated, the tools will have to be inserted horizontally from the side of the beam. This is the case for instance in so-called American style tooling. The beam here has a groove with a T-shaped or reverse L-shaped cross-section. This T-shaped or reverse L-shaped groove is made up of the above stated vertical groove and the horizontal groove, into which the safety catch protrudes. An example hereof is shown in the older, U.S. Pat. No. 6,928,852 of applicant.

As described, it is usual to drive the positioning pin by means of hydraulics. The advantage of hydraulics is that a great force can thereby be generated. A hydraulic clamping system can moreover be controlled in simple manner by the control of the machine. A drawback however is that a separate hydraulic unit is necessary for the purpose of operating the clamping system. As stated, in the case of a hydraulically driven machine this functionality can optionally be provided by extending the hydraulic system of the machine. Such a combination of functions is of course not possible in the case the machine is for instance electrically driven.

SUMMARY OF THE INVENTION

It is now the wish to provide a clamping system with which the tools can be efficiently clamped and positioned, but wherein the necessity for an external hydraulic unit is dispensed with. The clamping system is preferably electrical. The drawback of an electrical actuator for operation of the positioning pins is however that in its present form it takes up too much space.

The invention has for its object to provide a clamping system which meets the above stated requirements.

There are different options for obtaining a clamping force for clamping the tool in a clamping beam.

Firstly, a clamping force is possible on the basis of electromagnetism. A magnetic field is generated here by a coil arranged in the clamping beam. The metal body of the tool can then be attracted with this magnetic field. The thus generated clamping force depends particularly on the magnetic field to be generated.

Secondly, a clamping force can be obtained with piezoelectric elements, electrostrictive elements or magnetostrictive elements. Using such elements a very great clamping force can be obtained with a very small stroke.

Thirdly, it is possible to use memory metal in order to generate a force. The memory metal can be programmed such that it takes on a first form at a low temperature and a second form at a high temperature. A great force can be generated at the transition from the one form to the other.

Fourthly, a more conventional method of generating force is possible, for instance by means of an electric motor, the use of pneumatics or hydraulics. The force which can be thereby generated is relatively limited within the limits of the clamping device and without making use of a large external hydraulic or pneumatic unit.

The invention now has for its object to provide a clamping device with which the tools can also be clamped and positioned efficiently using one of the above stated mechanisms. This object is achieved with a clamping device for clamping a tool, which comprises a part which receives the tool, an actuated member, an engaging member to be brought into contact with the tool, and a transmission placed between the actuated member and the engaging member. By making use of a transmission either limited forces can be converted to a greater clamping force with an increase in the stroke required to generate the force, or a limited stroke with great force can be converted into a greater stroke with smaller force.

In a preferred embodiment of the clamping device according to the invention the actuated member is pneumatically driven. Use can thus be made of compressed air systems which are often already present in workplaces. In addition, a pneumatic drive is relatively clean due to the absence of liquids.

Conversely, it is also possible to envisage the actuated member being hydraulically driven. Owing to the presence of the transmission it is possible to suffice with a small hydraulic drive which can optionally be powered from the press brake itself.

In both cases the actuated member can comprise a cylinder/piston combination.

In an alternative embodiment of the clamping device according to the invention the actuated member is electrically driven. An electrical drive is compact and can be easily accommodated in the clamping device. The actuated member can here comprise for instance an electric motor or a piezoelectric element.

The transmission is preferably adapted to move the engaging member first relatively quickly and then more slowly toward the tool. The engaging member can thus be positioned quickly in the first instance, after which the development of the clamping force can then progress more gradually.

The clamping device is preferably self-braking. Once it has been clamped, the tool can thus be held in place substantially without exerting any force. This limits the energy consumption of the clamping device.

A structurally simple, compact and robust clamping device is obtained when the transmission comprises at least one wedge-shaped member.

For optimum generation of force it is recommended that the engaging member is displaceable in a first direction between a rest position clear of the tool and a clamping position engaging the tool, and the actuated member is displaceable in a second direction which encloses an angle with the first direction.

The direction of displacement of the wedge-shaped member here preferably lies substantially transversely of the direction of displacement of the engaging member. A large transmission ratio can thus be achieved.

In a structurally simple embodiment of the clamping device according to the invention the wedge-shaped member and the engaging member have co-acting contact surfaces, at least one of which has an at least partially straight progression.

Conversely, the wedge-shaped member and the engaging member can also have co-acting contact surfaces, at least one of which has an at least partially curved progression. In this manner a gradual build-up of force can be achieved, wherein the engaging member is first displaced relatively quickly with relatively little force, and latterly a greater force is developed wherein there is only little displacement. In this case the contact surfaces of the wedge-shaped member and the engaging member can advantageously take complementary forms so that they both contribute toward the desired displacement and build-up of force.

The contact surfaces of the wedge-shaped member and the engaging member are preferably formed such that they are self-braking. The clamping device can thus be given a self-braking form in simple manner.

The same effect can otherwise also be achieved when the contact surfaces have a number of straight segments with different angles of inclination.

Other combinations of displacement and build-up of force also become possible when the clamping device is further provided with at least one tumbler member placed between the wedge-shaped member and the engaging member.

An effective clamping device is obtained when the transmission comprises at least one lever. A desired transmission ratio can hereby be set in simple manner.

When the at least one lever forms part of a knee joint, wherein the actuated member acts on a central part of the knee joint, a high transmission ratio can be realized particularly at the end of a stroke.

For an optimal clamping of the tool it is recommended that the engaging member has a first surface which runs at an angle to its direction of movement and which co-acts with a second surface of the tool running at an angle to the clamping direction. "Clamping direction" is understood here to mean the direction in which the tool is positioned and clamping against placing surfaces of the clamping device. The tool can thus be pressed into the receiving part in desired manner by the engaging member.

The first surface of the engaging member then preferably has an angle of inclination other than the second surface of the tool, so that the tool can be urged into the clamping device.

The angles of the first and second surfaces of the engaging member and the tool are here advantageously chosen such that these surfaces are self-braking.

In order to prevent the tool falling out of the clamping beam when the clamping device is released, the tool preferably has at least one safety catch and the clamping device has at least one recess for receiving the safety catch.

The invention further relates to a press, in particular a press brake, which conventionally comprises a lower beam and an upper beam, wherein at least one of the beams is displaceable toward and away from the other beam, and wherein a clamping device as described above is arranged on or integrated into at least one of the beams.

BRIEF DESCRIPTION OF THE DRAWINGS

The invention is now further elucidated on the basis of a number of embodiments, wherein reference is made to the accompanying drawing, in which corresponding components are designated with the same reference numerals and in which.

DETAILED DESCRIPTION OF THE PREFERRED EMBODIMENTS

Figure 1:
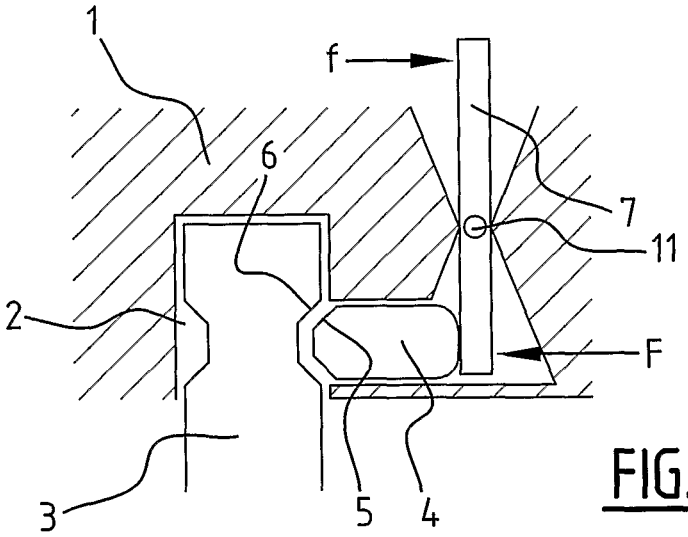
FIG. 1 is a schematic cross-section through an upper part of a clamping beam, which shows a clamping device according to a first embodiment of the invention with a part of a tool received therein.

FIG. 1 shows a first option for a transmission for increasing the force. FIG. 1 shows a clamping beam 1 with a vertical receiving space 2 therein. A tool 3 is pushed into this receiving space 2. An engaging member in the form of a positioning pin 4 further protrudes into receiving space 2. This positioning pin 4 is provided with a chamfered surface 5. Further formed in tool 3 is a positioning groove with a surface 6 which runs at an angle relative to the direction in which tool 3 is clamped (surfaces 5 and 6 are designed to co-act, but may have any possible embodiment, such as flat, concave, convex, undulating etc). When positioning pin 4 is now pressed into vertical receiving space 2, through co-action of chamfered surface 5 and surface 6 of the positioning groove in tool 3, positioning pin 4 will press tool 3 upward and simultaneously clamp tool 3 in vertical receiving space 2. Tool 3 is brought into the correct position by being pressed the upward.

In order to activate positioning pin 4 and produce sufficient force a transmission, here in the form of a lever 7, is provided behind positioning pin 4. With this lever 7, the larger part of which is situated here above a pivot shaft 11, a relatively small force f can be converted into a much greater force F in the opposite direction for fixedly clamping tool 3 by means of positioning pin 4. The relatively small force f could for instance be produced by an electromagnet, a screw spindle driven by an electric motor, a pneumatic cylinder and the like.

Figure 2:
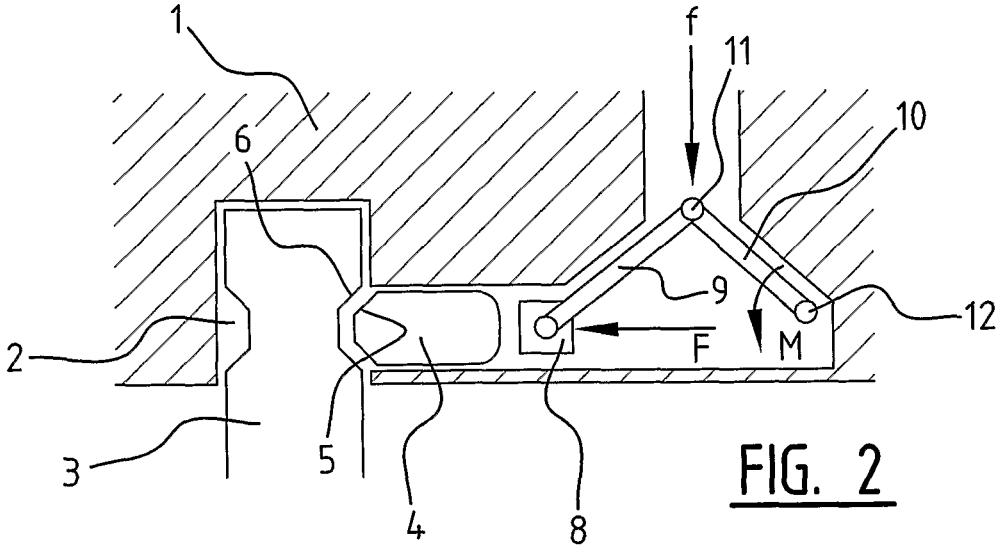
FIG. 2-10 show cross-sectional views corresponding to FIG. 1 of other embodiments of the clamping device according to the invention.

FIG. 2 shows a second transmission. Parts correspond to the embodiment according to FIG. 1, and corresponding components are therefore designated with the same reference numerals.

The engaging member, once again embodied as positioning pin 4, is activated in this embodiment by a transmission in the form of a knee mechanism which consists of a sliding block 8, a first rod 9 and a second rod 10. Sliding block 8 lies against positioning pin 4. First rod 9 is connected pivotally at one end to sliding block 8, while the other end is pivotally connected to second rod 10 via pivot shaft 11. Second rod 10 is in turn mounted pivotally on clamping beam 1 via pivot shaft 12.

When a relatively small force f is again now exerted on pivot point 11 or a moment M on pivot point 12, knee mechanism 8, 9, 10 will then extend and press positioning pin 4 into receiving space 2. As positioning pin 4 approaches its end position protruding into receiving space 2, and knee mechanism 8, 9, 10 hereby approaches its straightened position, an increasingly greater force F will here be exerted on positioning pin 4.

Figure 3:
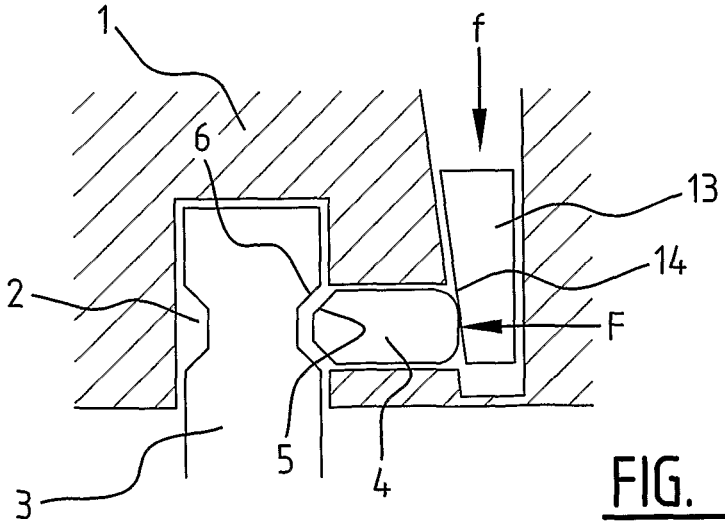

FIG. 3 shows a third transmission. Corresponding components are here also designated with the same reference numerals. For activation of positioning pin 4 use is made here of a transmission in the form of a vertically displaceable wedge 13. The ratio of the vertically directed force f exerted on wedge 13 and the horizontal force F exerted on positioning pin 4 depends on the angle of inclination of wedge surface 14. The smaller this angle becomes, the smaller the horizontal displacement of pin 4 will be, but the greater the force exerted thereon.

The displacement of wedge 13 can for instance take place here by means of a driven screw spindle, although preferably by means of a pneumatic cylinder.

Figure 4:
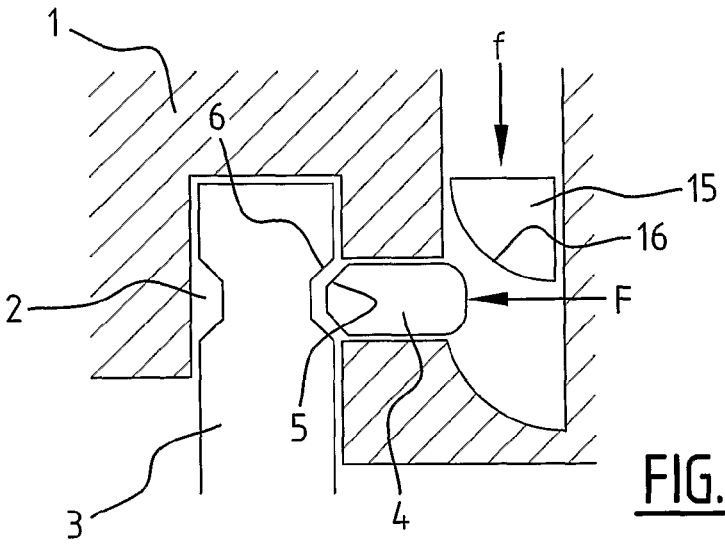

FIG. 4 shows a variant of the transmission of FIG. 3. Here too a wedge 15 is provided, although here the wedge surface 16 is curved. Arranging a curve in wedge surface 16 makes it possible in the first instance, with a uniform displacement of wedge 15, to bring about a relatively large displacement of pin-like engaging member 4 with a relatively small build-up of force. A relatively great force is then built up in the latter part of the stroke of positioning pin 4, whereby pin 4 is clamped in tool 3 and tool 3 therefore in receiving space 2.

Figure 5:
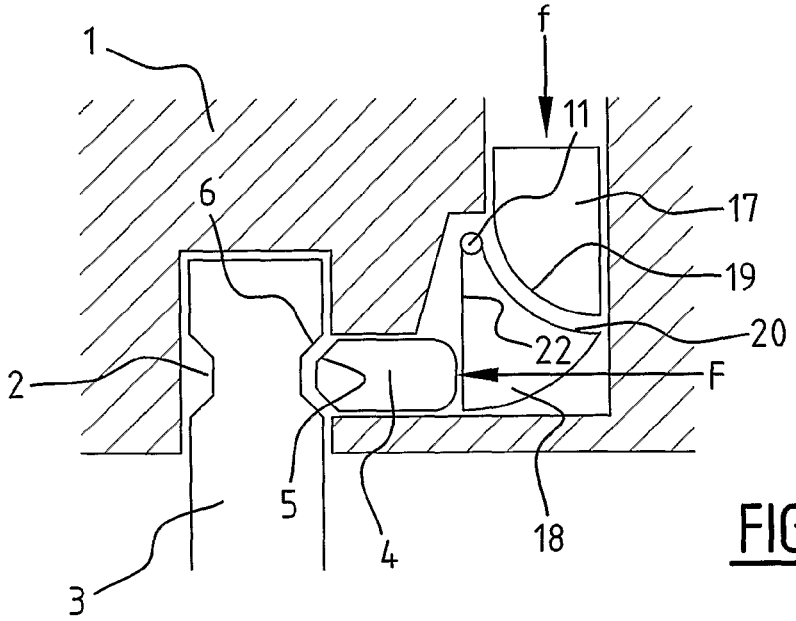

FIG. 5 shows a transmission which is formed by a wedge 17 and a tumbler part 18 pivotable about a shaft 11. This tumbler part 18 lies with a surface 22 against positioning pin 4. With a suitable design of wedge surface 19 and the tumbler surface 20 co-acting therewith a desired characteristic in the transmission can be obtained between the displacement of wedge 17 and positioning pin 4 and, associated therewith, the force f on wedge 17 and the force F which is exerted on positioning pin 4 by tumbler part 18.

Figure 6:
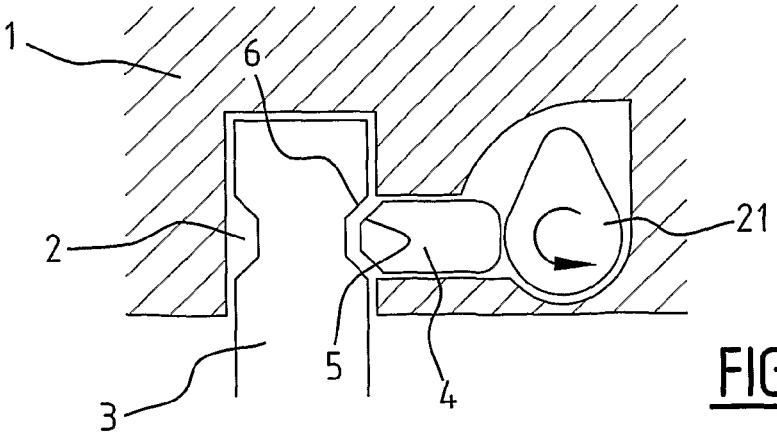

FIG. 6 shows a transmission by means of a cam 21 which can be driven rotatingly by an electric motor. This cam 21 lies against positioning pin 4, and positioning pin 4 is pressed into receiving space 2 by rotation of cam 21. With a suitable design of the surface of cam 21 it is once again possible to ensure that in the first part of the rotating movement the positioning pin 4 is carried into receiving space 2 relatively quickly, but with little force, and that the force F is developed only in the latter part of the movement for the purpose of fixedly clamping tool 3 through co-action of surfaces 5 and 6.

Figure 7:
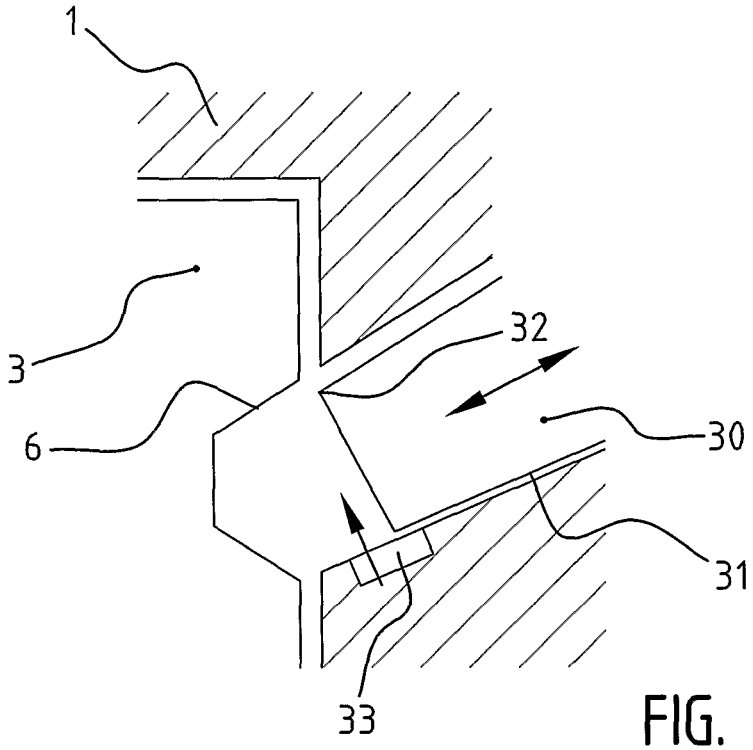

FIG. 7 shows a clamping device wherein, in contrast to the foregoing embodiments, no use is made of an engaging member in the form of a horizontally displaceable positioning pin 4 with a chamfered part 5. The engaging member and the transmission are instead integrated in a displaceable filler part 30. This filler part 30 is pushed into the positioning groove with the surface 6 of tool 3 running at an angle to the clamping direction.

Since tool 3 is in the first instance not yet fully positioned in receiving space 2, the lower surface 31 of filler part 30 preferably has a smaller angle than the inclination of surface 6 in the positioning groove, which typically amounts to about 45□. Tool 3 is hereby lifted during sliding in of filler part 30. Edge 32 of filler part 30, which can optionally also be chamfered or rounded off, will here slide along the inclining surface 6 of the positioning groove.

Once filler part 30 has been pushed into the positioning groove with surface 6, and tool 3 is thereby positioned in receiving space 2 in clamping beam 1, the desired clamping force can be generated using pressure element 33. Since tool 3 already lies against the walls of the groove in receiving space 2 after sliding in of filler part 30, it is not necessary for pressure element 33 to perform a large stroke. A piezo-element is in such a case a suitable choice for pressure element 33, since such a piezo-element can generate a great force with a relatively small deformation.

In this embodiment of the clamping device, wherein as stated no separate transmission is present, the displacement of filler part 30 into the positioning groove is in fact separate of the pressing of filler part 30 for the purpose of clamping tool 3.

Figure 8:
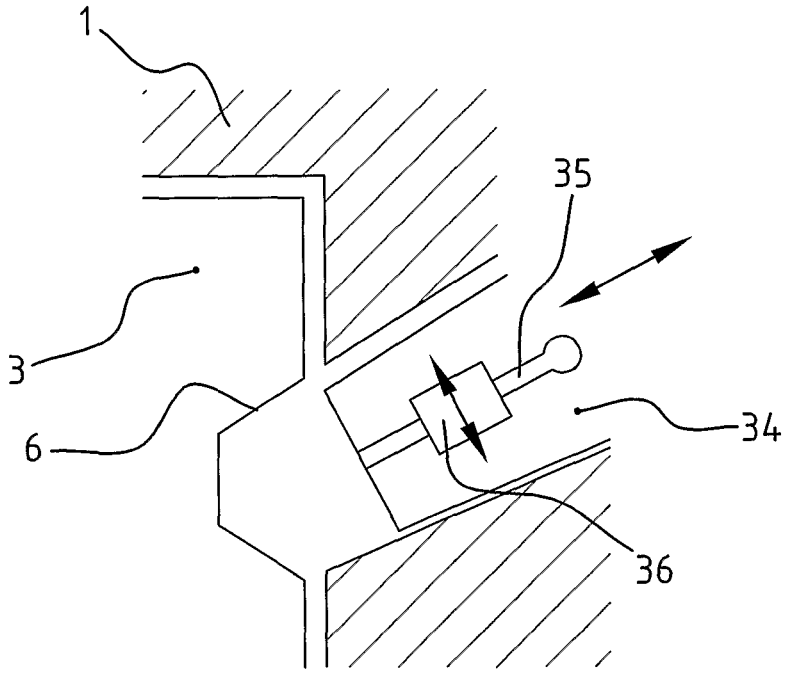

FIG. 8 shows a variant of the clamping device according to FIG. 7. Instead of a pressure element 33 in clamping beam 1, in this embodiment pressure element 36 is arranged in the filler part 34 itself. Filler part 34 is provided here with a long slot 35 which divides the end of filler part 34 into two parts. Placed in this slot 35 is pressure element 36 which pushes apart the two parts of filler part 34 and which, after filler part 34 has been placed into the positioning groove, thus provides the desired clamping force against inclining surface 6.

On the basis of the embodiments of FIGS. 7 and 8 the insight has been gained that the clamping force generated by pressure elements 33 and 36 need not be as great as in the case of a horizontal engaging member. In the case of a horizontal positioning pin 4, which is provided with a chamfered surface 5 and which co-acts with the inclining surface 6 of the positioning groove of tool 3, positioning pin 4 will be pressed back again into clamping beam 1 when a force is exerted on tool 3. When tool 3 is for instance pulled in vertical direction, it will have an opposite effect to when positioning pin 4 is pressed into receiving space 2 in order to lift and position tool 3 in receiving space 2. The more the insertion angle of filler part 30, 34 corresponds to the angle of inclination of inclining surface 6 in the positioning groove in tool 3, the less this effect will occur. When the angles are equal, there is then a form-fitting connection between tool 3 and clamping beam 1.

Figure 14:
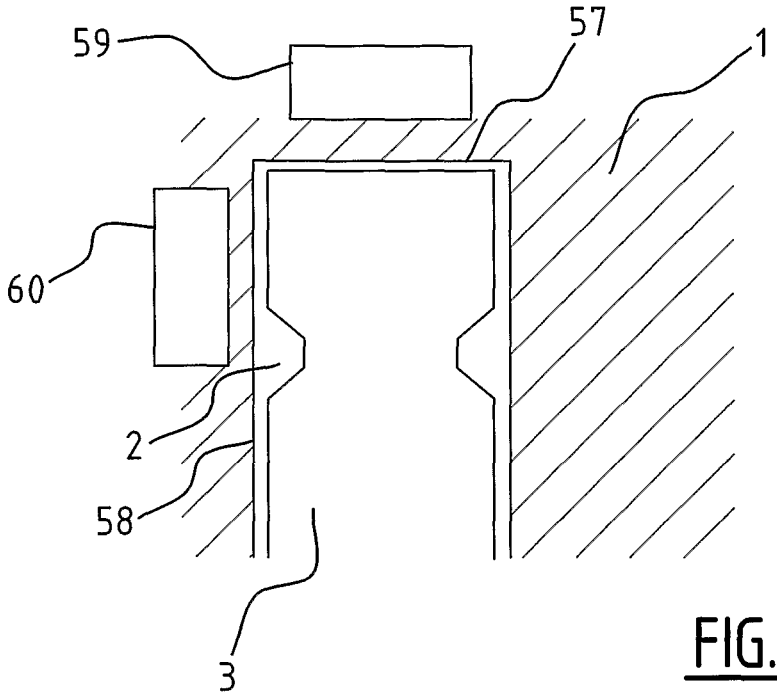
FIG. 14 shows a schematic cross-section through a clamping beam with an active magnetic clamping device.

It is however not possible in the shown embodiments to make the insertion angle of filler part 30, 34 equal to the angle of inclination of surface 6 of the positioning groove, since tool 3 will not immediately be fully positioned in receiving space 2 of clamping beam 1. In another embodiment it is possible to pull and position tool 3 into receiving space 2 by means of a magnet (FIG. 14). In such a case the insertion angle of the filler part, which then only serves for form-fitting locking of tool 3, can however be equal to the angle of inclination of surface 6 of the positioning groove.

Figure 9:
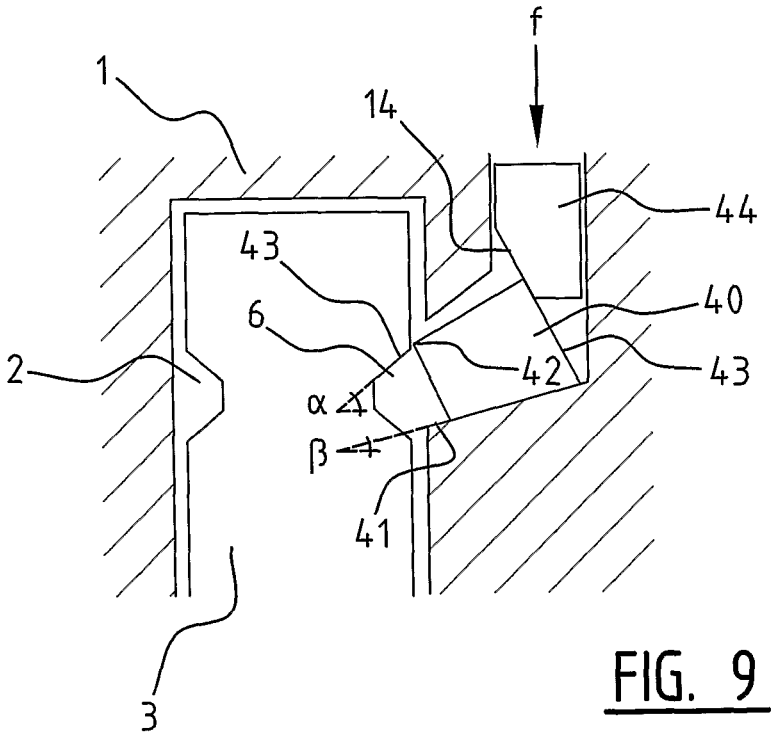
Figure 10:
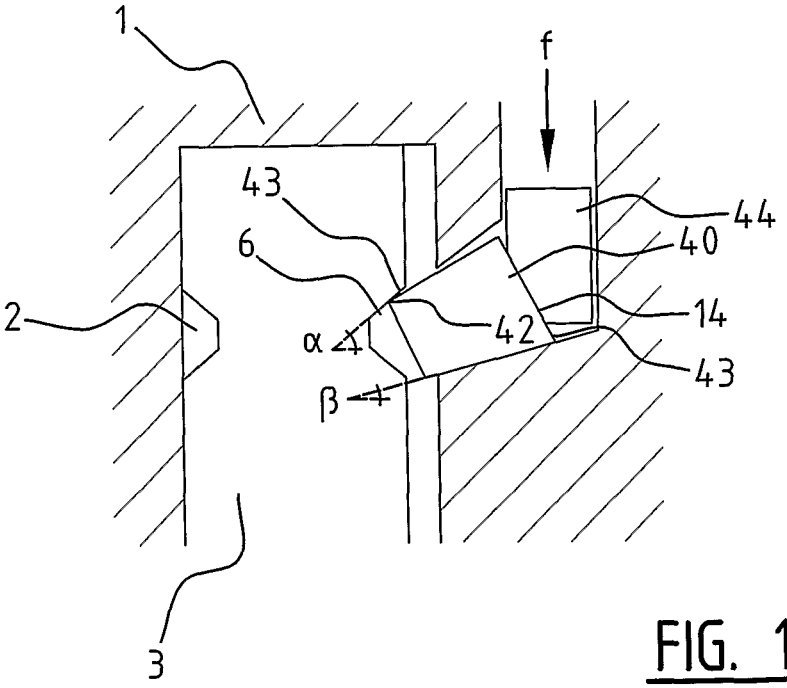

FIGS. 9 and 10 now show a clamping device which takes account of the above described insight. In this device a filler part 40 is once again provided which functions as engaging member. This filler part 40 runs over a surface 41 in clamping beam 1. This surface 41 has an angle β which differs from the angle α of surface 6 of the positioning groove. This difference between angles α and β ensures that edge 42 of filler part 40 will be pressed against surface 6 of the positioning groove in any possible starting position of tool 3. Thus ensured is that tool 3 is still positioned in receiving space 2 of clamping beam 1 by displacing filler part 40 in the positioning groove with surface 6. Although in the figures filler part 40 is guided along a flat surface 41 with an angle β, it is also possible to give this surface 41 a curvature, whereby a different movement of filler part 40 is obtained during insertion in the positioning groove.

The displacement of filler part 40 takes place in this embodiment with a transmission in the form of a vertically displaceable wedge 44, which engages with a wedge surface 14 on a chamfered end surface 43 of filler part 40. With a suitable ratio of the angle of wedge surface 14 and the angles α and β the relatively small force f which a force generator, such as an electric motor or a pneumatic jack, exerts on wedge 44 is converted into a greater clamping force on tool 3.

FIG. 10 shows the position in which tool 3 lies fully positioned in receiving space 2 of clamping beam 1. The engaging member or filler part 40 is here pushed into the positioning groove and point 42 of filler part 40 lies here against surface 6 of the positioning groove.

If angles α and β were substantially identical, a fully form-fitting locking of the tool would be obtained in FIG. 10, and an additional clamping force is unnecessary.

As a result of the friction forces that are present a form-fitting locking is also possible when the difference between α and β is small. Filler part 40 is then in fact self-braking. This depends on the chosen materials, lubrication and vibrations in the machine.

In order to obtain a guaranteed clamping it is possible to still generate sufficient friction through the choice of the angle of inclination of wedge 44, whereby a form-fitting locking is possible. Conversely, it is possible to continue exerting a small force f in order to guarantee the locking of the tool.

Figure 11:
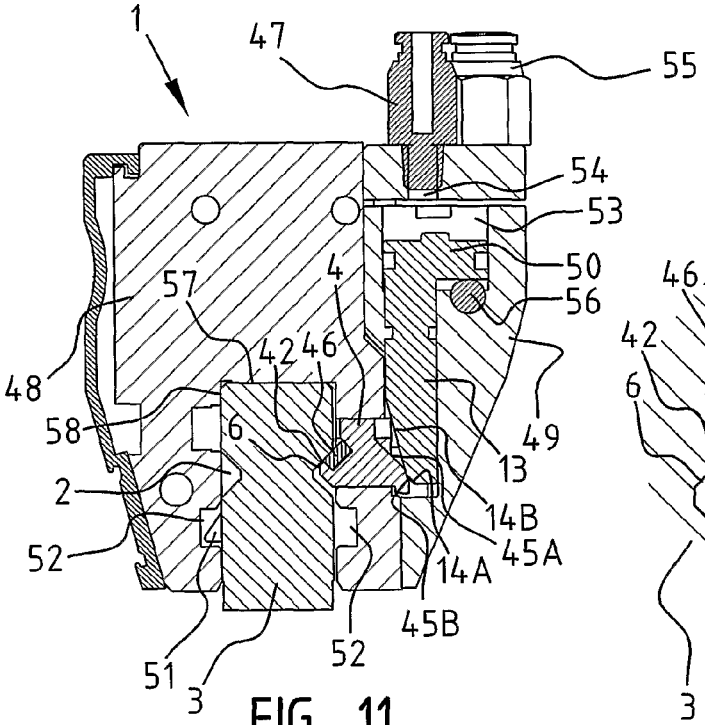
FIG. 11 shows a section through an upper clamping beam with a preferred embodiment of the clamping device with a tool clamped therein.
Figure 11A:
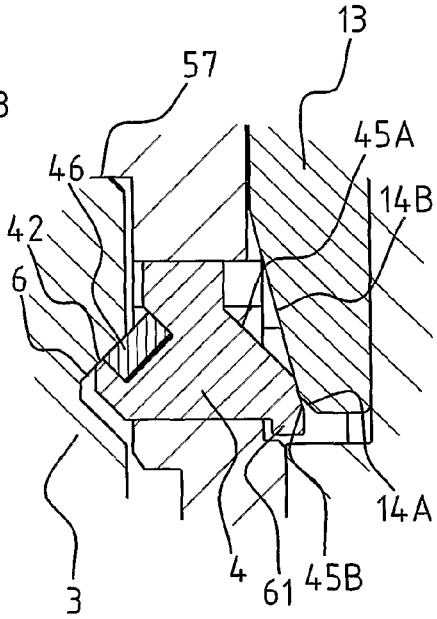
FIG. 11A shows on enlarged scale a detail of the engaging member and the transmission of the device of FIG. 11.

In a preferred embodiment of clamping device 1 (FIGS. 11, 12), which is based on the clamping principle shown in FIG. 3, the actuated member is of a pneumatic nature. It is formed by a pneumatic cylinder 53, which is received in a part 49 of clamping beam 1, and a piston or plunger 50 reciprocally movable therein. The underside of piston 50 is connected to a transmission, which is formed integrally therewith in the shown example. This transmission is formed by a vertically displaceable wedge 13 provided with two wedge surfaces 14A, 14B with different angles of inclination. In this embodiment engaging member 4 is likewise partially wedge-shaped and has two wedge surfaces 45A, 45B. This partially wedge-shaped engaging member 4 is received for horizontal displacement in another part 48 of clamping beam 1, in which receiving space 2 is also formed.

The pairs of wedge surfaces 14A, 14B and 45A, 45B co-act here so as to convert a vertical displacement with a substantially constant speed of the pneumatically driven, wedge-shaped transmission 13 into a horizontal displacement of wedge-shaped engaging member 4 at two different speeds. During a first part of the movement, when the relatively strongly inclining wedge surfaces 14A, 45A are mutually engaging, engaging member 4 is pressed at relatively high speed into the positioning groove of tool 3. During the latter part of the movement the relatively lightly inclining wedge surfaces 14B, 45B are mutually engaging, and the speed at which engaging member 4 is pressed into the positioning groove becomes much lower. A great force is however exerted here, which presses surface 42 of engaging member 4 against surface 6 of the positioning groove. Tool 3 is thus clamped between surface 42 of engaging member 4 and upper surface 57 and a side surface 58 of receiving space 2.

The angle of inclination of these wedge surfaces 14B, 45B is chosen here such that the relative sliding movement is self-braking and a form-fitting connection is in fact so created. In the clamped situation the pneumatically driven piston 50 need not therefore exert any, or hardly any, force on transmission 13 and engaging member 4, thereby limiting energy consumption. The self-braking character of the clamping device is further reinforced by a stiff insert 46, for instance of material used in brakes, in surface 42 of engaging member 4.

Insert 46 can also take the form of a piezoelectric element which can generate an additional clamping force. It is also possible to envisage insert 46 being manufactured from a slightly softer material than that of engaging member 4 and tool 3, for instance a soft metal or a hard plastic. Insert 46 can thus serve to compensate small differences in the position of two adjacent tools and so ensure a uniform clamping.

In the shown embodiment tool 3 is otherwise also provided with one or more safety catches 51 which engage in a recess 52 in clamping beam 1. Each safety catch 51 is biased to its protruding position by spring pressure and can be retracted manually or by operating an actuator.

In order to clamp a tool 3 in clamping device 1 compressed air is introduced in this example into cylinder 53 via an opening 54, whereby piston 50 and wedge-shaped transmission 13 are pressed downward. In order to relieve the clamping the piston 50 and transmission 13 must be moved upward again. Due to the self-braking or form-fitting character of the clamping a release force must be exerted directly on transmission 13 for this purpose. In this embodiment compressed air is introduced to this end into cylinder 53 via an opening 56 below piston 50. Piston 50 and wedge-shaped transmission 13 are thus pressed upward, whereby engaging member 4 can move to the right in the drawing when tool 3 is pulled downward out of receiving space 2. It is also possible to envisage engaging member 4 being moved to the right by a spring (not shown here) which engages on a heel 61 thereof. Tool 3 can otherwise only be removed after safety catch(es) 51 is/are retracted. Openings 54, 56 for the feed of compressed air to cylinder 53 are each connected to a conduit received in clamping beam 1. These conduits are in turn connected by means of connections 47, 55 to a source of compressed air, for instance an annular pneumatic conduit present in most workplaces and factories.

This embodiment of clamping device 1 could otherwise also be embodied hydraulically without great structural changes.

Figure 12:
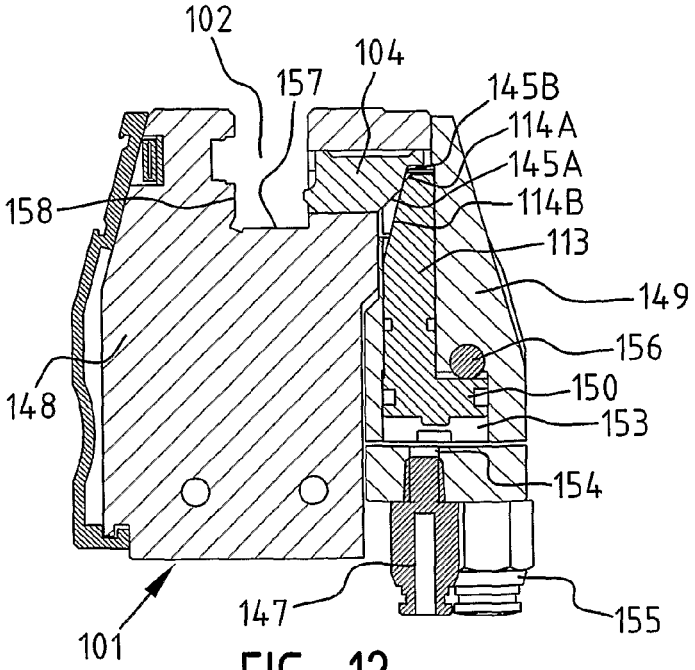
FIG. 12 shows a view corresponding with FIG. 11 of a lower clamping beam with the same clamping device in the released situation.

FIG. 12 shows a lower clamping beam 101 in which a clamping device is received similar to that in upper clamping beam 1. The most significant difference is that no recesses are provided for receiving safety catches of the tool. This is because there is no risk here of the tool falling from clamping beam 101 when the clamping device is detached.

Figure 13A:
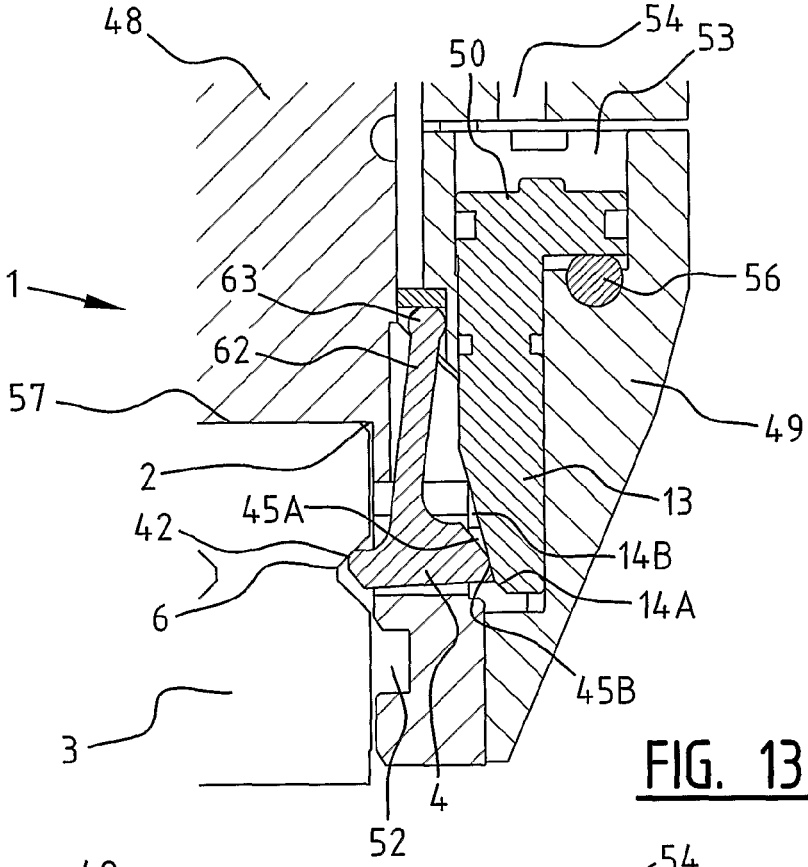
FIGS. 13A and 13B show views corresponding to FIG. 11 of an alternative embodiment of the clamping device, respectively with and without a tool for clamping.
Figure 13B:
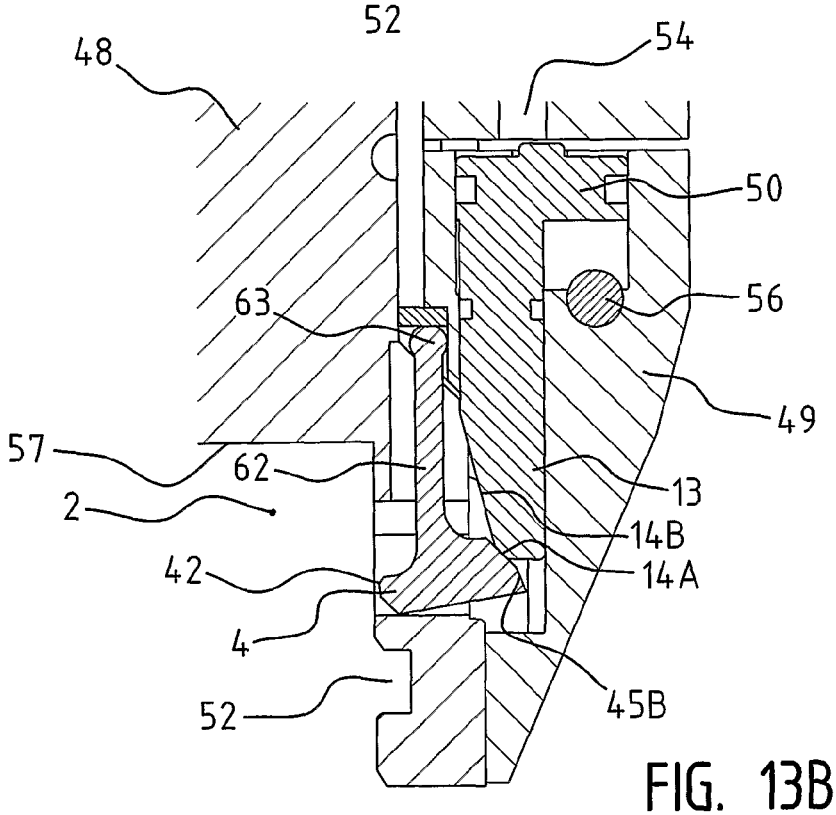

In a variant of clamping device 1 the engaging member 4 is not slidable in the clamping beam but is connected to a pivot shaft 63 via a pivot arm 62 (FIG. 13). A pivoting movement of engaging member 4 can be guided in simpler and more precise manner than a sliding movement.

FIG. 14 shows a first variant of a clamping device based on (electro)magnetism. Two electromagnets 59, 60 are arranged here in clamping beam 1, one in upper wall 57 of receiving space 2 and one in side wall 58 thereof. By actuating these magnets the tool 3 is drawn into receiving space 2 and held in place therein.

Figure 15:
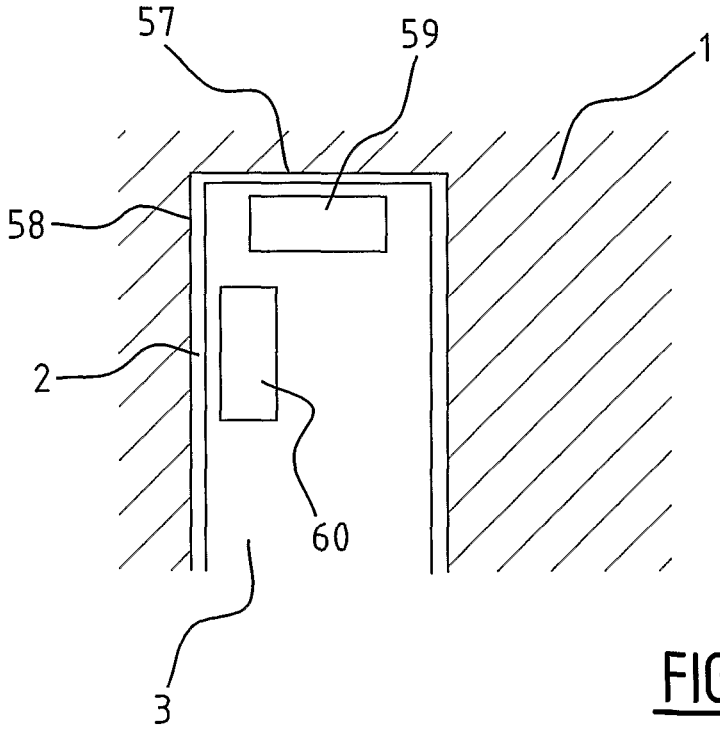
FIG. 15 is a view corresponding to FIG. 14, wherein a passive magnetic clamping device is shown in combination with a magnetic tool.

In an alternative embodiment of a magnetic clamping device the magnets 59, 60 are not arranged in clamping beam 1 but in tool 3 (FIG. 15). Through placing of these magnets 59, 60 tool 3 is once again drawn against upper wall 57 and one of the side walls 58 of receiving space 2. Although it is possible to envisage the use of electromagnets, which are actuated via electrical contacts in the walls of receiving space 2, it is also possible to apply permanent magnets.

It is otherwise recommended to properly insulate magnets 59, 60 in tool 3 in order to prevent tool 3 also functioning as a magnet outside clamping beam 1.

Instead of generating a clamping force by means of magnetic attraction, this force could also be generated by the same magnet poles repelling each other. A clamping device similar to that shown in FIG. 7 could thus be used, wherein filler part 30 can be pressed by a suitably poled magnet 33 against surface 6 of the positioning groove in tool 3.

In the embodiments of the clamping device based on (electro) magnetism it is otherwise possible to dispense with the use of a transmission.

The invention thus makes it possible, using a relatively clean and compact force-generating device such as a pneumatic jack or an electric motor, to generate great forces which forces hold a tool fixedly in a clamping beam of a press brake in reliable manner. It is thus possible to dispense with the use of a large external hydraulic unit. Even when the drive of the clamping device takes place by hydraulic means, it is after all possible by applying the transmission to suffice with relatively small amounts of hydraulic fluid and relatively low pressures, for which purpose use can be made of the hydraulic system of the press brake.

Although the invention is elucidated above on the basis of an embodiment, it will be apparent that it is not limited thereto but can be varied in numerous ways. The scope of the invention is defined solely by the following claims.

The invention claimed is:

1. A clamping device for clamping a tool, comprising a part receiving the tool and an actuated member, an engaging member to be brought into contact with the tool, and a transmission placed between the actuated member and the engaging member, wherein the clamping device is self-braking, and wherein the actuated member is pneumatically or hydraulically driven.

2. The clamping device as claimed in claim 1, wherein the actuated member comprises a cylinder/piston combination.

3. The clamping device as claimed in claim 1, wherein the transmission is adapted to move the engaging member first relatively quickly and them more slowly toward the tool.

4. The clamping device as claimed in claim 1, wherein the transmission comprises at least one lever.

5. The clamping device as claimed in claim 4, wherein the at least one lever forms part of a knee joint, and wherein the actuated member acts on a central part of the knee joint.

6. The clamping device as claimed in claim 1, wherein the tool has at least one safety catch and the clamping device has at least one recess for receiving the safety catch.

7. A clamping device for clamping a tool comprising a part receiving the tool and an actuated member, an engaging member to be brought into contact with the tool, and a transmission placed between the actuated member and the engaging member wherein the clamping device is self-braking and wherein the actuated member is electrically driven.

8. The clamping device as claimed in claim 7, wherein the actuated member comprises an electric motor.

9. The clamping device as claimed in claim 7, wherein the actuated member comprises a piezoelectric element.

10. The clamping device as claimed in claim 9, wherein the engaging member and the transmission are formed integrally.

11. The clamping device as claimed in claim 7, wherein the actuated member comprises an electromagnet.

12. The clamping device as claimed in claim 7, wherein the tool has at least one safety catch and the clamping device has at least one recess for receiving the safety catch.

13. A clamping device for clamping a tool, comprising, a part receiving the tool and an actuated member, an engaging member to be brought into contact with the tool, and a transmission placed between the actuated member and the engaging member, the transmission comprising at least one wedge-shaped member, wherein the clamping device is self-braking, and wherein the engaging member is displaceable in a first direction between a rest position clear of the tool and a clamping position engaging the tool, and the actuated member is displaceable in a second direction which encloses an angle with the first direction.

14. The clamping device as claimed in claim 13, wherein the direction of displacement of the wedge-shaped member lies substantially transversely of the direction of displacement of the engaging member.

15. The clamping device as claimed in claim 13, wherein the wedge-shaped member and the engaging member have co-acting contact surfaces, at least one of which has an at least partially straight progression.

16. The clamping device as claimed in claim 13, wherein the wedge-shaped member and the engaging member have co-acting contact surfaces, at least one of which has an at least partially curved progression.

17. The clamping device as claimed in claim 16, wherein the contact surfaces of the wedge-shaped member and the engaging member take complementary forms.

18. The clamping device as claimed in claim 15, wherein the contact surfaces of the wedge-shaped member and the engaging member are formed such that they are self-braking.

19. The clamping device as claimed in claim 13, further comprising at least one tumbler member placed between the wedge-shaped member and the engaging member, the tumbler member being pivotable about a shaft and having one surface co-acting with a surface of the wedge-shaped member and another surface co-acting with a surface of the engaging member.

20. The clamping device as claimed in claim 13, wherein the actuated member and the transmission are formed integrally.

21. A clamping device for clamping a tool, comprising a part receiving, the tool and an actuated member, an engaging member to be brought into contact with the tool, and a transmission placed between the actuated member and the engaging member, wherein the clamping device is self-braking, wherein the engaging member has a first surface which runs at an angle to its direction of movement and which co-acts with a second surface of the tool naming at an angle to the clamping direction, and wherein the angles of the first and second surfaces of the engaging member and the tool are chosen such that these surfaces are self-braking.

22. The clamping device as claimed in claim 21, wherein the first surface of the engaging member has an angle of inclination other than the second surface of the tool.

23. A press, in particular press brake, comprising a lower beam and an upper beam, wherein at least one of the beams is displaceable toward and away from the other beam, and a clamping device arranged on or integrated into at least one of the beams, wherein the clamping device comprises a part receiving the tool and an actuated member, an engaging member to be brought into contact with the tool, and a transmission placed between the actuated member and the engaging member, wherein the clamping device is self-braking.

24. A clamping device for clamping a tool, comprising a part receiving the tool and an actuated member, an engaging member to be brought into contact with the tool, and a transmission placed between the actuated member and the engaging member, wherein the transmission comprises at least one wedge-shaped member, the clamping device comprising at least one tumbler member placed between the wedge-shaped member and the engaging member, wherein the tumbler member is pivotable about a shaft and having one surface co-acting with a surface of the wedge-shaped member and another surface co-acting with a surface of the engaging member.

* * * * *

UNITED STATES PATENT AND TRADEMARK OFFICE

CERTIFICATE OF CORRECTION

PATENT NO. : 8,943,870 B2
APPLICATION NO. : 13/124342
DATED : February 3, 2015
INVENTOR(S) : Franciscus Wilhelmus Rouweler et al.

It is certified that error appears in the above-identified patent and that said Letters Patent is hereby corrected as shown below:

In the Claims

Column 10, Line 13, Claim 3, delete “them” and insert -- then --

Column 10, Line 39, Claim 13, after “comprising” delete “,”

Column 11, Line 12, Claim 21, after “receiving” delete “,”

Column 11, Line 18, Claim 21, delete “naming” and insert -- running --

Signed and Sealed this
Twenty-sixth Day of May, 2015

Michelle K. Lee

Michelle K. Lee
*Director of the United States Patent and Trademark Office*